United States Patent [19]

Aoki et al.

[11] 4,107,392

[45] Aug. 15, 1978

[54] HIGH TEMPERATURE ABRASION-RESISTANT MATERIAL AND METHOD OF PRODUCING SAME

[75] Inventors: Hiroyuki Aoki, Yokohama; Hiroshi Takao, Kamakura; Akira Oyamada, Yokohama, all of Japan

[73] Assignee: Nissan Motor Company, Limited, Japan

[21] Appl. No.: 750,622

[22] Filed: Dec. 15, 1976

[30] Foreign Application Priority Data

Dec. 25, 1975 [JP] Japan ..... 50-155485

[51] Int. Cl.[2] ..... C22C 1/05

[52] U.S. Cl. ..... 428/547; 75/201; 75/206; 264/60; 264/64; 264/65; 264/66

[58] Field of Search ..... 264/63, 60, 64, 65, 264/66; 51/309; 106/55, 65; 75/82, 206, 208 R, 201; 428/547

[56] References Cited

U.S. PATENT DOCUMENTS

| | | | |
|---|---|---|---|
| 2,004,595 | 6/1935 | Benner et al. | 264/63 |
| 2,460,356 | 2/1949 | Kreidl et al. | 264/60 |
| 3,148,981 | 9/1964 | Ryshkewitch | 264/60 |
| 3,522,103 | 7/1970 | White et al. | 264/66 |

*Primary Examiner*—Donald J. Arnold

[57] ABSTRACT

A high temperature abrasion-resistant material in the form of a sintered mass such as a board consists of NiO and/or CoO, Ni and/or Co, and a solid lubricant such as $CaF_2$. The concentration of the total oxide in the mass is maximum at the surface and continuously decreases as the depth from the surface increases, but the concentration of the total metal is substantially zero at the surface and continuously increases as the depth increases. The lubricant is uniformly distributed. This material is produced by firstly sintering a powder mixture of the ingredients in a non-oxidizing atmosphere into a mass of a desired shape and subsequently heating the sintered mass in an oxidizing atmosphere.

19 Claims, 2 Drawing Figures

● OXIDE

○ METAL

× HALIDE

⊗ OXIDE
○ METAL
× HALIDE

HIGH TEMPERATURE ABRASION-RESISTANT MATERIAL AND METHOD OF PRODUCING SAME

This invention relates to a high temperature abrasion-resistant material in the form of a sintered mass which is not liable to crack or separate into two layers even when used in a high temperature oxidizing atmosphere and accordingly is useful particularly as a lubricating material or a seal material for regenerators in gas turbines and a method of producing the same.

BACKGROUND OF THE INVENTION

An abrasion-resistant material which is stable even in an oxidizing atmosphere of above 500° C is needful for articles subject to movement in such atmosphere, typified by a rotary regenerator in a gas turbine, as the material of a seal layer or a lubricating layer which provides a rubbing contact face.

At present, an abrasion-resistant layer for such purpose is usually produced by coating a surface of a metal substrate such as a stainless steel sheet with a plasma-sprayed mixture of a heavy metal oxide such as nickel oxide or cobalt oxide and a solid lubricating material typified by calcium fluoride. A coating of this type is desired to have a sufficiently large thickness for acquiring a long life and protecting the substrate against corrosion and temperature rise. However, it is difficult to make the thickness more than about 1 mm because, as the coating is formed to a larger thickness, a separation into two layers tends to occur in the coating due to thermal stress during a spraying process. Besides, an abrasion-resistant layer of this type is rather susceptible to heat shocks, probably because of a difference in thermal expansion coefficient between the substrate material and the coated material, and tends to exhibit a separation from the substrate or an undercoat layer during use.

Sometime, an abrasion-resistant layer or board is produced by sintering a powder mixture of the above described heavy metal oxide and solid lubricating material. However, a great difference of the melting point of the solid lubricating material (about 1300°–1400° C) from that of the heavy metal oxide (about 1800°–2000° C) offers a significant problem to the sintering. The sintering temperature should be as high as about 1600°–1800° C to realize a fully sintered structure, but the solid lubricant completely melts at such high temperature and develops a considerable quantity of gas, resulting in an undesirably great porosity and fragility of the sintered product. Besides, an inherently poor formability of the material (as a property common to ceramics, the described material in the form of a board breaks without undergoing plastic deformation) also leads to an insufficient toughness and wear resistance of the sintered product.

SUMMARY OF THE INVENTION

It is an object of the present invention to provide a high temperature abrasion-resistant material in the form of a sintered mass which is resistant also to heat shocks and can be used as a layer for providing a rubbing contact face even in an oxidizing atmosphere of about 800° C without suffering from cracks or internal separation.

It is another object of the invention to provide a high temperature abrasion-resistant material in the form of a sintered mass which is useful as a seal material or a lubricating material for a rotary regenerator in a gas turbine.

It is still another object of the invention to provide a method of producing a high temperature abrasion-resistant material according to the invention.

A high temperature abrasion-resistant material according to the invention is a sintered mass which consists essentially of at least one oxide of a heavy metal selected from NiO and CoO, at least one heavy metal selected from Ni and Co, and at least one halide of an alkaline earth metal selected from the fluorides, chlorides and bromides of Ca, Ba and Sr and is characterized in that the concentration of the total heavy metal oxide in the mass is maximum at the surface of the mass and continuously decreases as the depth from the surface increases, that the concentration of the total metal in the mass is substantially zero at the surface and continuously increases as the depth from the surface increases and that the halide is uniformly distributed in the mass.

This mass provides a highly abrasion-resistant rubbing contact face since a surface region of the mass is composed only of the metal oxide and the halide which is a well known solid lubricant. The mass is very tough even at high temperatures around 800° C because of firstly the presence of the metal and resultant metal-to-metal and metal-to-oxide bonds in the interior and secondary the continuous and inverse concentration gradients of the metal oxide and the metal.

A first method of producing the high temperature abrasion-resistant material according to the invention comprises the steps of: preparing a powder mixture of at least one powdered heavy metal oxide selected from NiO and CoO, at least one powdered heavy metal selected from Ni and Co and at least one powdered halide of an alkaline earth metal selected from the fluorides, chlorides and bromides of Ca, Ba and Sr; sintering the powder mixture into a mass of a desired shape in a non-oxidizing atmosphere at a temperature in the range from 1100° to 1500° C to cause the liberation of the metal from a portion of the metal oxide and promote the bonding of the metal particles to each other and to the metal oxide particles; and thereafter heating the sintered mass in an oxidizing atmosphere to oxidize a portion of the metal present in the mass such that the concentration of the total metal oxide in the mass becomes maximum at the surface of the mass and continuously decreases as the depth from the surface increases and that the concentration of the total metal in the mass becomes substantially zero at the surface and continuously increases as the depth from the surface increases.

The non-oxidizing atmosphere may either be an inactive gas atmosphere such as a nitrogen atmosphere or vacuum.

A second method of producing the abrasion-resistant material according to the invention comprises the steps of: preparing a powder mixture of at least one powdered oxide of a heavy metal selected from NiO and CoO and at least one powdered halide of an alkaline earth metal selected from the fluorides, chlorides and bromides of Ca, Ba and Sr; sintering the powder mixture into a mass of a desired shape in a reducing atmosphere at a temperature in the range from 1100° to 1500° C to cause the liberation of the metal from a portion of the metal oxide and promote the bonding of the metal particles to each other and to the metal oxide particles; and thereafter heating the sintered mass in an oxidizing atmosphere to oxidize a portion of the metal present in the mass such that the concentrations of the total metal oxide and the total metal become as described in the first method.

It is permissible to add at least one powdered heavy metal selected from Ni and Co to the powder mixture in the second method prior to the sintering.

An example of the reducing atmosphere in the second method is vacuum in the presence of graphite.

In both the first and second production methods, the lower limit of the sintering temperature is set at 1100° C because the employment of a lower sintering temperature results in incomplete sintering and accordingly an insufficient physical strength of the sintered mass. On the other hand, the sintering temperature should not exceed 1500° C because a higher sintering temperature causes the melting and gas-generating decomposition of the halide, resulting in an excessively porous and fragile structure of the product. The sintering step in either the first or second method may be carried out by firstly press-forming the powder mixture into a mass of a desired shape at room temperature and then sintering the formed mass under the described condition or may alternatively be carried out by a hot-press technique in which the shaping and sintering are simultaneously accomplished.

In both methods, the final heating step for oxidation may be accomplished in air preferably at a temperature in the range from 500° to 1100° C. This step is indispensable to the production of the abrasion-resistant material according to the invention since a complete oxidation of the metal component at the surface and the negative concentration gradient of the metal oxide towards the core are achieved by this heat treatment. However, it is undesirable to firstly form a compacted body of a mixture of the heavy metal and the halide (not using the heavy metal oxide) because of a difficulty in attaining the required concentration gradient of the metal oxide by a subsequent heating in an oxidizing atmosphere. The sintering step in the second method should be performed not to excessively reduce the metal oxide from the same reason. If the metal oxide component is completely or almost completely reduced at the sintering step, metal-to-metal bonds become dominant in the structure of the sintered body, so that conjunctive micropores are absent from the sintered body or included only insufficiently for the permeation of an oxidizing gas into the sintered body.

Calcium fluoride is preferred as the halide or solid lubricant and contained in the powder mixture to be sintered in an amount of 3–50% by weight.

DESCRIPTION OF PREFERRED EMBODIMENTS

EXAMPLE 1

Powdered NiO and/or CoO were mixed with powdered $CaF_2$, and the resultant mixture was admixed with powdered Ni and/or Co. Every powder material was not larger than 150 μm in particle size. The composition of the ultimate mixture was varied as presented in the following Table 1.

Each of these nine sample mixtures was press-formed into a board of about 5 mm in thickness at room temperature under a load of 5000 kg/cm$^2$. The board was sintered in a nitrogen atmosphere at 1250° C for 3 hr and thereafter subjected to a 3 hr heat treatment at 1000° C in air for oxidation.

Figure 1:
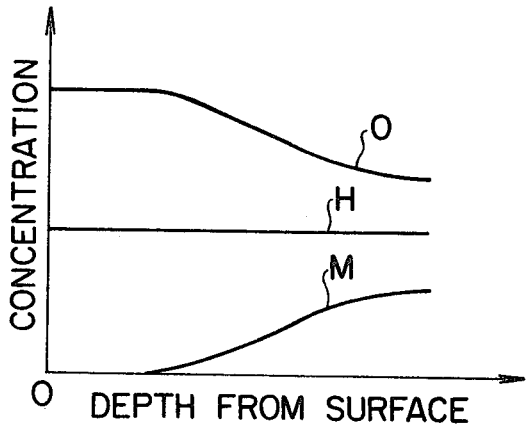
FIG. 1 is a graph showing variations in the respective concentrations of the metal oxide component, metal component and halide component in a high temperature abrasion-resistant material in the form of board according to the invention at various depths from the surface thereof.
Figure 2:
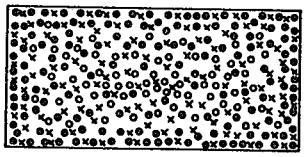
FIG. 2 shows a sectionally viewed structure model of an abrasion-resistant board material according to the invention.

In the thus produced board materials, a surface region was composed only of the metal oxide (NiO and/or CoO) and $CaF_2$: the metal (Ni and/or Co) was practically absent from this region as the result of the oxidation of the metal. In a core region, the three components, the metal oxide, calcium fluoride and the metal, were all present. However, no definite boundary was found between the surface region and the core region since the concentration of the total metal in the board continuously increased while the concentration of the total metal oxide continuously decreased as the depth from every surface of the board increased. The concentration of $CaF_2$ was constant at any depth. FIG. 1 is an explanatory graph showing the variations in the respective concentrations of the three components of the board material with respect to the depth from the surface of the board; the curves O, H and M represent the total metal oxide, the metal halide and the total metal, respectively. FIG. 2 presents a cross-sectionally viewed structure model of the board material, wherein the metal oxide, the halide and the metal are symbolized by black circles, cross-marks and white circles, respectively. The respective gradients of the curves O and M vary depending on the sintering condition and the oxidation condition.

Table 1

| Sample | Composition (Wt%) | | | | | Abrasion rate (mg/hr. cm$^2$) | | |
|---|---|---|---|---|---|---|---|---|
| | NiO | CoO | Ni | Co | $CaF_2$ | 800° C | 700° C | 600° C |
| A | 80 | 0 | 15 | 0 | 5 | 0.08 | 0.10 | 0.20 |
| B | 45 | 0 | 35 | 0 | 20 | 0.05 | 0.08 | 0.17 |
| C | 20 | 0 | 35 | 0 | 45 | 0.07 | 0.10 | 0.18 |
| D | 0 | 80 | 0 | 15 | 5 | 0.08 | 0.11 | 0.20 |
| E | 0 | 45 | 0 | 35 | 20 | 0.05 | 0.07 | 0.17 |
| F | 0 | 20 | 0 | 35 | 45 | 0.08 | 0.08 | 0.19 |
| G | 30 | 50 | 5 | 10 | 5 | 0.09 | 0.10 | 0.18 |
| H | 25 | 20 | 20 | 15 | 20 | 0.05 | 0.06 | 0.17 |
| I | 10 | 10 | 20 | 15 | 45 | 0.07 | 0.09 | 0.19 |

An abrasion test was carried out on the sample boards of this example by pressing one side of each board against an AISI 304 stainless steel sheet at a load of 9 kg/cm$^2$ and continuously rubbing at a relative speed of 2 m/min. The test was continued for 30 hr in an oxidizing atmosphere (air) at 600°, 700° or 800° C, and the weight loss of each sample board was measured as an abrasion rate. The results are presented in Table 1. No crack or separation appeared in the tested boards.

A similar abrasion test was carried out by using an alumina-base ceramic board in place of the stainless sheet, but the result was not significantly different. Both the stainless sheet and the alumina-base ceramic board did not exhibit appreciable abrasion wear in these tests. When the powder mixtures of this example were formed into a board by a multi-stage compacting and sintering technique, a further improvement in the physical strength of the board obtained through the above described oxidation process was achieved.

EXAMPLE 2

Powdered NiO and/or CoO were mixed with powdered $CaF_2$ in various proportions as shown in Table 2. Every powder was not larger than 150 μm in particle size. A sintered body in the form of board was produced from each of these powder mixtures by a hot-press technique which was carried out under a vacuum of $10^{-2}$ atm at 1200° C by maintaining a load of 300 kg/cm² for 15 min. Graphite was used as a material of the molds and/or the heater elements for this operation to realize a weakly reducing atmosphere in the furnace for the hot-pressing. A portion of the metal oxides contained in the powder mixture was reduced to the respective metals during this operation, so that the sintered board contained the metals both in its surface region and in core region. Thereafter the sintered board was heated in air at 1000° C for 3 hr to oxidize a portion of the metals. In a surface region, the metals were almost completely oxidized.

Table 2

| Sample | Composition (Wt%) | | | Abrasion rate (mg/hr.cm²) | | |
|---|---|---|---|---|---|---|
| | NiO | CoO | $CaF_2$ | 800° C | 700° C | 600° C |
| J | 95 | 0 | 5 | 0.05 | 0.07 | 0.13 |
| K | 80 | 0 | 20 | 0.02 | 0.05 | 0.13 |
| L | 60 | 0 | 40 | 0.03 | 0.06 | 0.14 |
| M | 0 | 95 | 5 | 0.05 | 0.07 | 0.14 |
| N | 0 | 80 | 20 | 0.02 | 0.04 | 0.12 |
| O | 0 | 60 | 40 | 0.03 | 0.05 | 0.12 |
| P | 35 | 60 | 5 | 0.04 | 0.06 | 0.13 |
| Q | 40 | 40 | 20 | 0.03 | 0.04 | 0.11 |
| R | 40 | 20 | 40 | 0.04 | 0.06 | 0.14 |

The abrasion test according to Example 1 was carried out also on the sample boards J-R of Example 2, and the results were as presented in Table 2 (the abrasion rate values were against the stainless sheet, but almost similar data were obtained against the alumina ceramic board). No crack or internal separation appeared in the tested boards.

To confirm our belief that excellent abrasion resistance at high temperatures of a board material according to the invention is not principally derived from the chemical composition of the starting powder material but is derived from the presence of a certain amount of metal in the product and the nonuniform distribution of the total metal oxide and total metal contained therein, the following reference experiments were performed.

REFERENCE 1

An abrasion-resistant layer was formed on an AISI 304 stainless steel substrate by plasma-spraying each of the nine powder mixtures prepared in Example 2. The abrasion test according to Example 1 was carried out on the thus produced conventional abrasion-resistant layers and gave the data as shown in Table 3.

Table 3

| Sample | Composition (Wt%) | | | Abrasion rate (mg/hr.cm²) | | |
|---|---|---|---|---|---|---|
| | NiO | CoO | $CaF_2$ | 800° C | 700° C | 600° C |
| $J_1$ | 95 | 0 | 5 | | 1.5 | 2.2 |
| $K_1$ | 80 | 0 | 20 | | 0.9 | 1.2 |
| $L_1$ | 60 | 0 | 40 | | 1.1 | 1.3 |
| $M_1$ | 0 | 95 | 5 | | 1.4 | 1.7 |
| $N_1$ | 0 | 80 | 20 | | 0.8 | 1.2 |
| $O_1$ | 0 | 60 | 40 | | 1.1 | 1.5 |
| $P_1$ | 35 | 60 | 5 | | 1.5 | 1.8 |
| $Q_1$ | 40 | 40 | 20 | | 0.8 | 1.0 |
| $R_1$ | 40 | 20 | 40 | | 1.3 | 1.6 |

The abrasion rate measurement on these layers $J_1$ – $R_1$ at 800° C was abandoned because every one of them exhibited separation either from the substrate or at a certain distance from the outer surface when once and temporarily heated to 800° C and then cooled to room temperature. (None of the abrasion-resistant boards A–R of Examples 1 and 2 exhibited any internal separation when subjected to repeated cycles of rapid heating to 800° C and rapid cooling to room temperature.) The abrasion rate values at 600° C and 700° C given in Table 3 are 15–22 times as large as the values in Table 2 for the respectively corresponding compositions.

REFERENCE 2

According to a known method, each of the nine powder mixtures prepared in Example 2 was press-formed under a load of 5000 kg/cm² into a board and then sintered in air at 1350° C for 3 hr. The abrasion test according to Example 1 was carried out on the thus produced conventional abrasion-resistant boards $J_2$–$R_2$ and gave the abrasion rate values as shown in Table 4.

Table 4

| Sample | Composition (Wt%) | | | Abrasion rate (mg/hr.cm²) | | |
|---|---|---|---|---|---|---|
| | NiO | CoO | $CaF_2$ | 800° C | 700° C | 600° C |
| $J_2$ | 95 | 0 | 5 | 1.0 | 0.9 | 1.0 |
| $K_2$ | 80 | 0 | 20 | 0.5 | 0.4 | 0.6 |
| $L_2$ | 60 | 0 | 40 | 0.7 | 0.6 | 0.7 |
| $M_2$ | 0 | 95 | 5 | 1.0 | 0.8 | 0.9 |
| $N_2$ | 0 | 80 | 20 | 0.6 | 0.5 | 0.7 |
| $O_2$ | 0 | 60 | 40 | 0.8 | 0.6 | 0.7 |
| $P_2$ | 35 | 60 | 5 | 0.9 | 0.9 | 1.0 |
| $Q_2$ | 40 | 40 | 20 | 0.5 | 0.4 | 0.5 |
| $R_2$ | 40 | 20 | 40 | 0.8 | 0.7 | 0.8 |

Compared with the abrasion-resistant boards J–R of Example 2, the conventional abrasion-resistant boards $J_2$–$R_2$ respectively produced from the same powder materials individually exhibited 7–12 times as large as abrasion rate values.

As hereinbefore demonstrated, an abrasion-resistant board according to the invention is distinctly superior in the resistances to abrasion and heat shocks to a conventional coating of a resembling material formed by plasma spraying and a conventional board formed by a usual sintering technique. As another advantage of the invention, a superior abrasion-resistant body can be produced through a sintering operation at a relatively low temperature. Furthermore, physical properties of an abrasion-resistant body according to the invention can variously be modulated by regulating the pressing, sintering and/or oxidizing conditions which determine the metal oxide concentration gradient in the produced body. Accordingly the body will be of a variety of use. Since the abrasion-resistant body includes a metallic phase, the body can be joined with a separate article by means of bolts or a solder and is convenient for practical use.

What is claimed is:

1. A high temperature abrasion-resistant material in the form of a sintered mass consisting essentially of at least one heavy metal oxide selected from the group consisting of NiO and CoO, at least one heavy metal selected from the group consisting of Ni and Co, said at least one heavy metal each being a constituent of at least one heavy metal oxide, and at least one halide of an alkaline earth metal selected from the group consisting of the fluorides, chlorides and bromides of Ca, Ba and Sr, the concentration of the total heavy metal oxide in the sintered mass being maximum at the surface of the mass and continuously decreasing as the depth from the surface increases, the concentration of the total heavy metal in the sintered mass being substantially zero at the surface of the mass and continuously increasing as the depth from the surface increases, the halide being uniformly distributed in the sintered mass.

2. A material as claimed in claim 1, wherein said at least one halide is $CaF_2$.

3. A material as claimed in claim 1, wherein said sintered mass takes the form of a board.

4. A method of producing a high temperature abrasion-resistant material in the form of a sintered mass according to claim 1, comprising the steps of:

preparing a powder mixture of at least one powdered heavy metal oxide selected from the group consisting of NiO and CoO, at least one powdered heavy metal selected from the group consisting of Ni and Co, said at least one heavy metal each being a constituent of said at least one heavy metal oxide, and at least one halide of an alkaline earth metal selected from the group consisting of the fluorides, chlorides and bromides of Ca, Ba and Sr;

sintering said powder mixture into a mass of a desired shape in a non-oxidizing atmosphere at a temperature in the range from 1100° to 1500° C to cause the liberation of at least one heavy metal from a portion of said at least one heavy metal oxide and promote the bonding of the heavy metal particles to each other and to the heavy metal particles; and heating the sintered mass in an oxidizing atmosphere to oxidize a portion of the heavy metal present in said mass such that the concentration of the total heavy metal oxide in said mass becomes maximum at the surface of said mass and continuously decreases as the depth from the surface increases and that the concentration of the total heavy metal in said mass becomes substantially zero at the surface of said mass and continuously increases as the depth from the surface increases.

5. A method as claimed in claim 4, wherein said non-oxidizing atmosphere is a nitrogen gas atmosphere.

6. A method as claimed in claim 4, wherein said non-oxidizing atmosphere is vacuum.

7. A method as claimed in claim 4, wherein the last step is performed in air at a temperature in the range from 500° to 1100° C.

8. A method as claimed in claim 4, wherein the sintering step is performed by firstly press-forming said powder mixture into a mass of a desired shape at room temperature and then sintering the shaped mass under the recited condition.

9. A method as claimed in claim 4, wherein the sintering step is performed by press-forming said powder mixture under the recited sintering condition.

10. A method as claimed in claim 4, wherein said at least one halide is $CaF_2$.

11. A method as claimed in claim 10, wherein said powder mixture contains $CaF_2$ in an amount of 3 to 50% by weight of said powder mixture.

12. A method of producing a high temperature abrasion-resistant material in the form of a sintered mass according to claim 1, comprising the steps of:

preparing a powder mixture of at least one powdered heavy metal oxide selected from the group consisting of NiO and CoO, and at least one halide of an alkalline earth metal selected from the group consisting of the fluorides, chlorides and bromides of Ca, Ba and Sr;

sintering said powder mixture into a mass of a desired shape in a reducing atmosphere at a temperature in the range from 1100° to 1500° C to cause the liberation of at least one heavy metal from a portion of said at least one heavy metal oxide and promote the bonding of the heavy metal particles to each other and to the heavy metal oxide particles; and heating the sintered mass in an oxidizing atmosphere to oxidize a portion of the heavy metal present in the sintered mass such that the concentration of the total heavy metal oxide in the sintered mass becomes maximum at the surface of the sintered mass and continuously decreases as the depth from the surface increases and that the concentration of the total heavy metal in the sintered mass becomes substantially zero at the surface of the sintered mass and continuously increases as the depth from the surface increases.

13. A method as claimed in claim 12, further comprising the step of adding at least one powdered heavy metal selected from the group consisting of Ni and Co to said powder mixture prior to the sintering step.

14. A method as claimed in claim 12, wherein said reducing atmosphere is vacuum in the presence of graphite.

15. A method as claimed in claim 12, wherein the sintering step is performed by firstly press-forming said powder mixture into a mass of a desired shape at room temperature and then sintering the shaped mass under the recited condition.

16. A method as claimed in claim 12, wherein the sintering step is performed by press-forming said powder mixture under the recited sintering condition.

17. A method as claimed in claim 12, wherein the last step is performed in air at a temperature in the range from 500° to 1100° C.

18. A method as claimed in claim 12, wherein said at least one halide is $CaF_2$.

19. A method as claimed in claim 18, wherein said powder mixture contains $CaF_2$ in an amount of 3 to 50% weight of said powder mixture.

* * * * *